US009861149B1

(12) United States Patent
Strollo

(10) Patent No.: US 9,861,149 B1
(45) Date of Patent: Jan. 9, 2018

(54) DEPLOYABLE HEAD COVERING DEVICE

(71) Applicant: Joyce Strollo, The Villages, FL (US)

(72) Inventor: Joyce Strollo, The Villages, FL (US)

( * ) Notice: Subject to any disclaimer, the term of this patent is extended or adjusted under 35 U.S.C. 154(b) by 0 days.

(21) Appl. No.: 15/278,189

(22) Filed: Sep. 28, 2016

(51) Int. Cl.
*A42B 1/00* (2006.01)
*A45D 8/36* (2006.01)

(52) U.S. Cl.
CPC ..... *A42B 1/006* (2013.01); *A45D 8/36* (2013.01)

(58) Field of Classification Search
CPC ..... A42B 1/006; A45D 8/36
See application file for complete search history.

(56) References Cited

U.S. PATENT DOCUMENTS 625,776 A * 5/1899 Von Klein ..... A42B 1/201 2/171.6
1,665,750 A * 4/1928 McKee ..... A42B 1/062 2/12
3,381,309 A * 5/1968 Cohen ..... A42B 1/006 135/34.2
3,480,970 A * 12/1969 Gettinger ..... A42B 1/045 2/171
4,453,276 A * 6/1984 Smith ..... A42B 1/043 2/200.1
4,630,317 A 12/1986 Brown et al.
4,741,053 A * 5/1988 Okamura, Sr. ..... A42B 1/22 2/12
5,046,195 A * 9/1991 Koritan ..... A41D 13/0512 2/172
5,062,157 A 11/1991 Muta
5,099,524 A 3/1992 Linday
5,875,493 A * 3/1999 MacDonald ..... A01K 55/00 2/10
6,260,206 B1 7/2001 MacDonald et al.
D458,004 S * 6/2002 Magdziak-Hautala ..... D2/500
D462,508 S * 9/2002 Jones ..... D2/891
6,453,475 B1 * 9/2002 Johnson ..... A42B 1/201 2/175.1
D522,216 S 6/2006 Strong
7,200,874 B2 4/2007 Leguenec
9,084,446 B2 * 7/2015 Ramadan ..... A41D 23/00
D738,596 S * 9/2015 Tang ..... D2/876
2011/0016613 A1 6/2011 Warrick
2013/0239293 A1 * 9/2013 Wu ..... A42B 1/18 2/209.13

FOREIGN PATENT DOCUMENTS

WO WO2006099840 9/2006

* cited by examiner

*Primary Examiner* — Shaun R Hurley
*Assistant Examiner* — Andrew W Sutton

(57) ABSTRACT

A deployable head covering device for selectively covering a portion of a user's head includes a band that has opposing ends. The band is resilient. The band is arcuate such that the opposing ends are proximately positioned. The device includes a panel with a top end that is complementary to the band. The top end is coupled to the band. The panel is flexible. The panel is reversibly positionable between furled and unfurled configurations. The opposing ends are configured to reversibly separate, such that the band is configured to reversibly couple to a head of a user. The panel is configured for selective positioning in the unfurled configuration, such that the panel selectively covers a portion of the head of the user.

10 Claims, 3 Drawing Sheets

DEPLOYABLE HEAD COVERING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to head covering devices and more particularly pertains to a new head covering device for selectively covering a portion of a user's head.

BRIEF SUMMARY OF THE INVENTION

An embodiment of the disclosure meets the needs presented above by generally comprising a band that has opposing ends. The band is resilient. The band is arcuate such that the opposing ends are proximately positioned. The device comprises a panel with a top end that is complementary to the band. The top end is coupled to the band. The panel is flexible. The panel is reversibly positionable between furled and unfurled configurations. The opposing ends are configured to reversibly separate, such that the band is configured to reversibly couple to a head of a user. The panel is configured for selective positioning in the unfurled configuration, such that the panel selectively covers a portion of the head of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
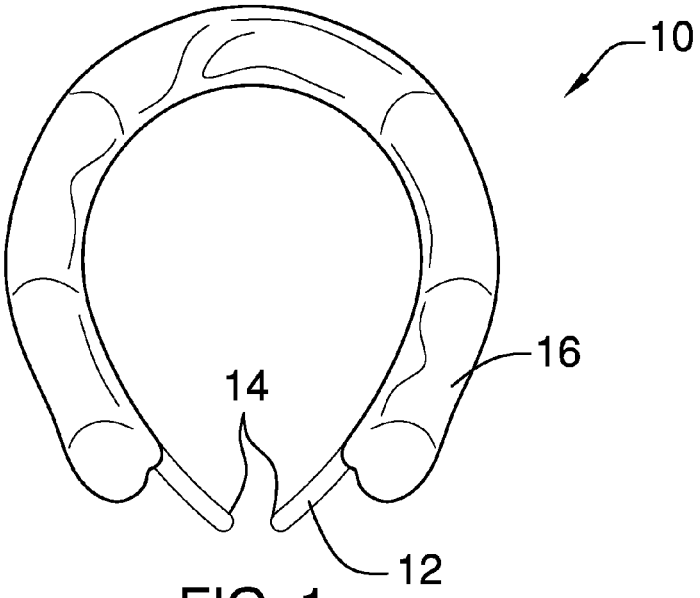
FIG. 1 is a top view of a deployable head covering device according to an embodiment of the disclosure.
Figure 2:
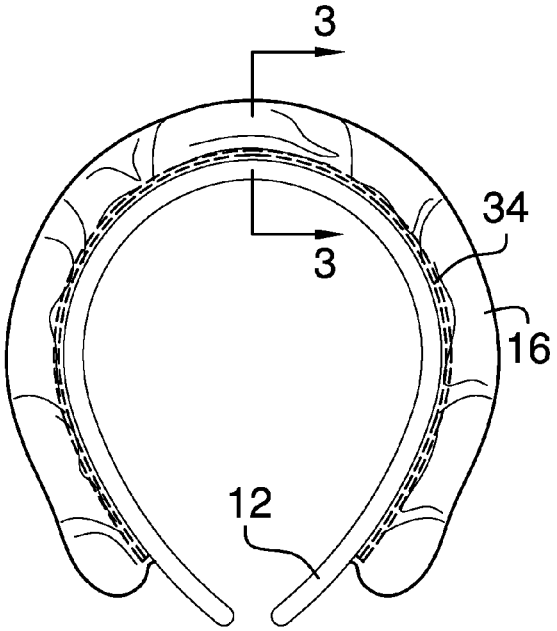
FIG. 2 is a bottom view of an embodiment of the disclosure.
Figure 3:
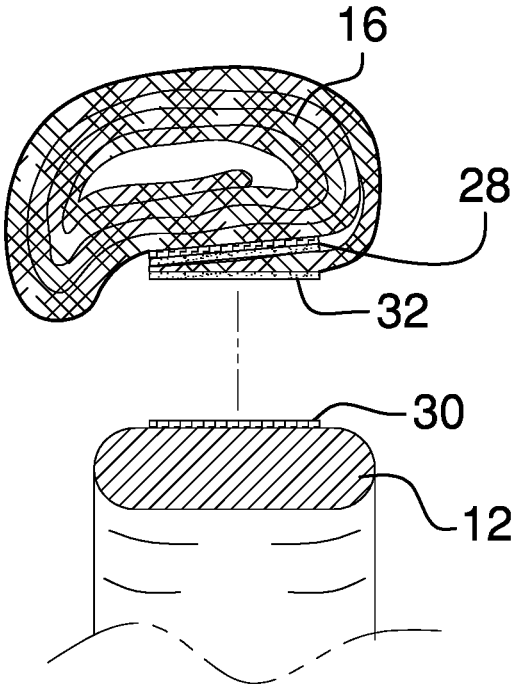
FIG. 3 is a cross-sectional view of an embodiment of the disclosure.
Figure 4:
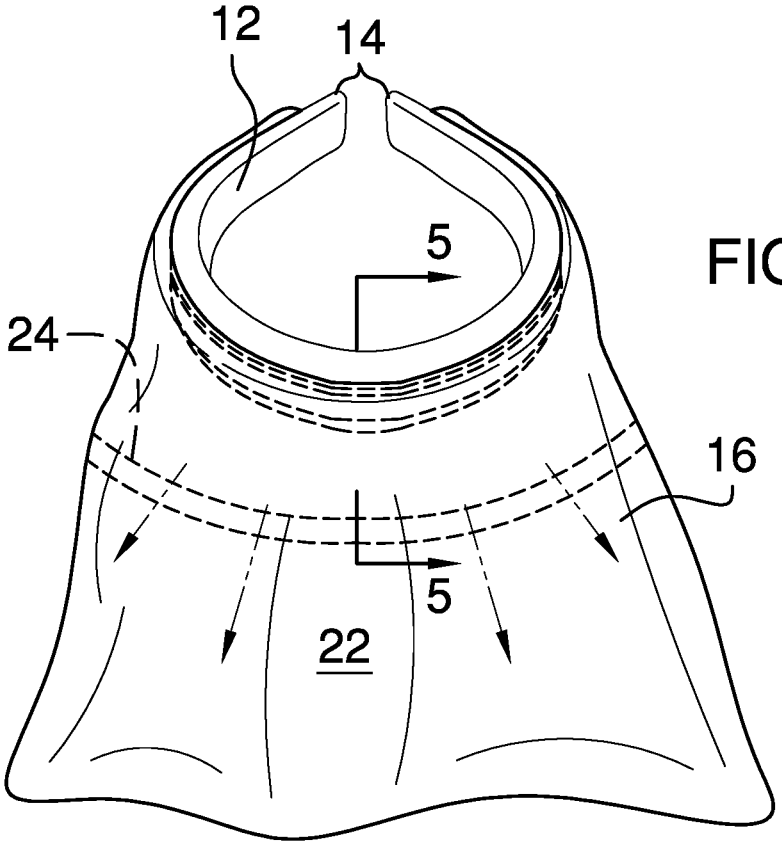
FIG. 4 is an isometric perspective view of an embodiment of the disclosure.
Figure 5:
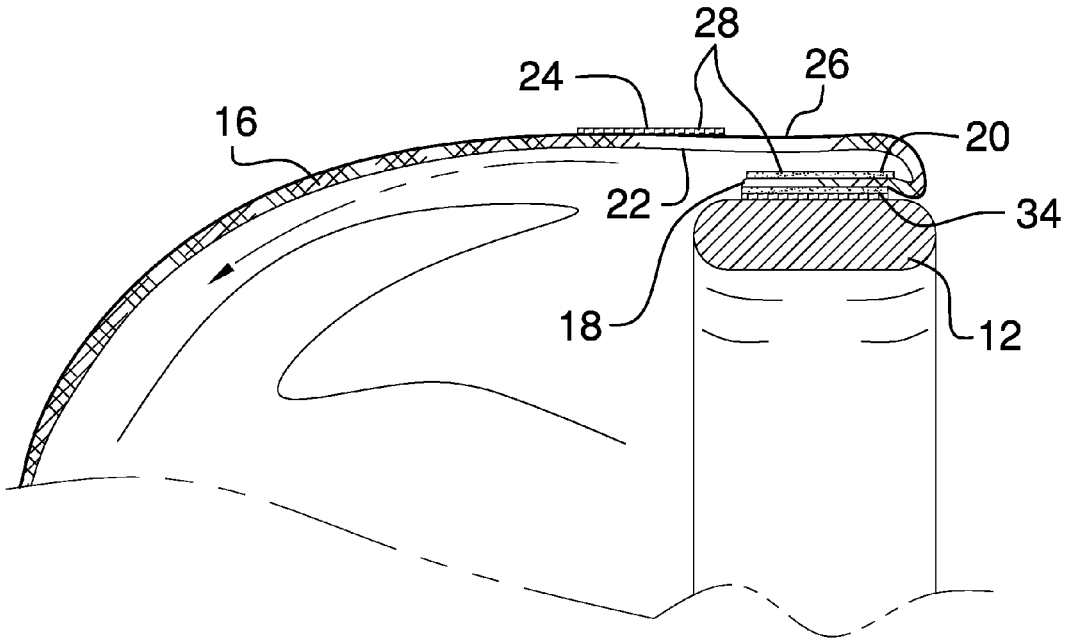
FIG. 5 is a detail view of an embodiment of the disclosure.
Figure 6:
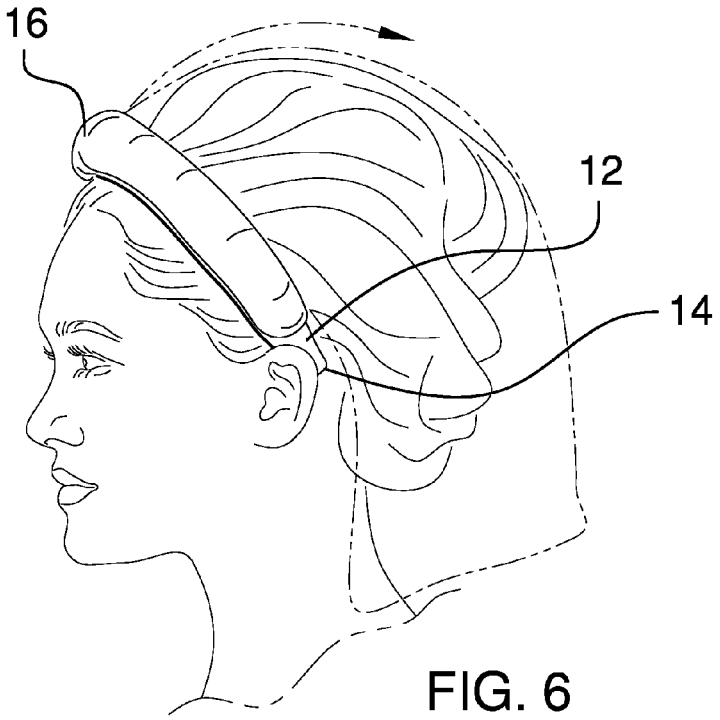
FIG. 6 is an in-use view of an embodiment of the disclosure.

With reference now to the drawings, and in particular to FIGS. 1 through 6 thereof, a new head covering device embodying the principles and concepts of an embodiment of the disclosure and generally designated by the reference numeral 10 will be described.

As best illustrated in FIGS. 1 through 6, the deployable head covering device 10 generally comprises a band 12 that has opposing ends 14. The band 12 is resilient. The band 12 is arcuate such that the opposing ends 14 are proximately positioned. The opposing ends 14 are configured to reversibly separate. The band 12 is configured to reversibly couple to a head of a user. In one embodiment, the band 12 comprises plastic.

The device 10 comprises a panel 16 that has a top end 18. The top end 18 is substantially complementary to the band 12. The top end 18 is coupled to the band 12. The panel 16 is flexible. The panel 16 is reversibly positionable between furled and unfurled configurations. In one embodiment, the panel 16 is water impermeable. In another embodiment, the panel 16 is absorbent of ultraviolet radiation. In yet another embodiment, the panel 16 comprises fabric.

A first coupler 20 is coupled to the panel 16 adjacent to the top end 18. The first coupler 20 is positioned on an outside face 22 of the panel 16. A second coupler 24 is coupled to the panel 16 proximate to the top end 18. The second coupler 24 is positioned on an inside face 26 of the panel 16. The second coupler 24 is complementary to the first coupler 20. The second coupler 24 is positioned to couple to the first coupler 20 to secure the panel 16 in the furled configuration. The second coupler 24 also is positioned to decouple from the first coupler 20 to motivate the panel 16 from the furled configuration to the unfurled configuration, wherein the panel 16 is configured to selectively cover a portion of the head of the user. In one embodiment, the first coupler 20 and the second coupler 24 comprise a first nylon hook and loop fastener 28.

In one embodiment, the panel 16 is reversibly couplable to the band 12. A first connector 30 is coupled to the band 12. A second connector 32 is coupled to the panel 16 adjacent to the top end 18. The second connector 32 is positioned on the inside face 26 of the panel 16. The second connector 32 is complementary to the first connector 30. The second connector 32 is positioned on the panel 16 such that the second connector 32 is positioned to couple to the first connector 30 to reversibly couple the panel 16 to the band 12. In another embodiment, the first connector 30 and the second connector 32 comprise a second nylon hook and loop fastener 34.

In use, the opposing ends 14 are configured to reversibly separate such that the band 12 is configured to reversibly couple to the head of the user. The second coupler 24 is positioned to couple to the first coupler 20 to secure the panel 16 in the furled configuration. The second coupler 24 also is positioned to decouple from the first coupler 20 to motivate the panel 16 from the furled configuration to the unfurled configuration, wherein the panel 16 is configured to selectively cover the portion of the head of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deployable head covering device comprising:

a band having opposing ends, said band being resilient, said band being arcuate such that said opposing ends are proximately positioned;

a panel having a top end, said top end being substantially complementary to said band, said top end being coupled to said band, said panel being flexible, said panel being reversibly positionable between furled and unfurled configurations;

wherein said opposing ends are positioned on said band such that said opposing ends are configured for reversibly separating such that said band is configured for reversibly coupling to a head of a user, wherein said panel is configured for selective positioning from the furled to the unfurled configuration such that said panel selectively covers a portion of the head of the users;

a first coupler coupled to said panel adjacent to said top end, said first coupler being positioned on an outside face of said panel;

a second coupler coupled to said panel proximate to said top end, said second coupler being positioned on an inside face of said panel, said second coupler being complementary to said first coupler; and wherein said second coupler is positioned on said panel such that said second coupler is positioned to couple to said first coupler to secure said panel in the furled configuration, and wherein said second coupler is positioned on said panel such that said second coupler is positioned to decouple from said first coupler to motivate said panel from the furled configuration to the unfurled configuration, such that said panel is configured to selectively cover the portion of the head of the user.

2. The device of claim 1, further including said band comprising plastic.

3. The device of claim 1, further including said panel being water impermeable.

4. The device of claim 1, further including said panel being absorbent of ultraviolet radiation.

5. The device of claim 1, further including said panel comprising fabric.

6. The device of claim 1, further including said first coupler and said second coupler comprising a first nylon hook and loop fastener.

7. The device of claim 1, further including said panel being reversibly couplable to said band.

8. A deployable head covering device comprising:

a band having opposing ends, said band being resilient, said band being arcuate such that said opposing ends are proximately positioned;

a panel having a top end, said top end being substantially complementary to said band, said top end being coupled to said band, said panel being flexible, said panel being reversibly positionable between furled and unfurled configurations, said panel being reversibly couplable to said band;

wherein said opposing ends are positioned on said band such that said opposing ends are configured for reversibly separating such that said band is configured for reversibly coupling to a head of a user, wherein said panel is configured for selective positioning from the furled to the unfurled configuration such that said panel selectively covers a portion of the head of the user;

a first connector coupled to said band;

a second connector coupled to said panel adjacent to said top end, said second connector being positioned on said inside face of said panel, said second connector being complementary to said first connector; and wherein said second connector is positioned on said panel such that said second connector is positioned to couple to said first connector to reversibly couple said panel to said band.

9. The device of claim 8, further including said first connector and said second connector comprising a second nylon hook and loop fastener.

10. A deployable head covering device comprising:

a band having opposing ends, said band being resilient, said band being arcuate such that said opposing ends are proximately positioned, wherein said opposing ends are positioned on said band such that said opposing ends are configured for reversibly separating such that said band is configured for reversibly coupling to a head of a user, said band comprising plastic;

a panel having a top end, said top end being substantially complementary to said band, said top end being coupled to said band, said panel being flexible, said panel being reversibly positionable between furled and unfurled configurations, said panel being water impermeable, said panel being absorbent of ultraviolet radiation, said panel comprising fabric, said panel being reversibly couplable to said band;

a first coupler coupled to said panel adjacent to said top end, said first coupler being positioned on an outside face of said panel;

a second coupler coupled to said panel proximate to said top end, said second coupler being positioned on an inside face of said panel, said second coupler being complementary to said first coupler, wherein said second coupler is positioned on said panel such that said second coupler is positioned to couple to said first coupler to secure said panel in the furled configuration, and wherein said second coupler is positioned on said panel such that said second coupler is positioned to decouple from said first coupler to motivate said panel from the furled configuration to the unfurled configuration, such that said panel is configured to selectively cover a portion of the head of the user, said first coupler and said second coupler comprising a first nylon hook and loop fastener;

a first connector coupled to said band;

a second connector coupled to said panel adjacent to said top end, said second connector being positioned on said inside face of said panel, said second connector being complementary to said first connector, wherein said second connector is positioned on said panel such that said second connector is positioned to couple to said first connector to reversibly couple said panel to said band, said first connector and said second connector comprising a second nylon hook and loop fastener; and wherein said opposing ends are positioned on said band such that said opposing ends are configured for reversibly separating such that said band is configured for reversibly coupling to a head of a user, wherein said second coupler is positioned on said panel such that said second coupler is positioned to couple to said first coupler to secure said panel in the furled configuration, and wherein said second coupler is positioned on said panel such that said second coupler is positioned to decouple from said first coupler to motivate said panel from the furled configuration to the unfurled configuration, such that said panel is configured to selectively cover the portion of the head of the user.

* * * * *